US008636015B1

(12) United States Patent
Brley

(10) Patent No.: US 8,636,015 B1
(45) Date of Patent: Jan. 28, 2014

(54) PERMANENT HAIR WAVE DEVICE

(76) Inventor: Crystal D. Brley, Bakersfield, CA (US)

( * ) Notice: Subject to any disclaimer, the term of this patent is extended or adjusted under 35 U.S.C. 154(b) by 0 days.

(21) Appl. No.: 13/478,931

(22) Filed: May 23, 2012

Related U.S. Application Data

(60) Provisional application No. 61/489,036, filed on May 23, 2011.

(51) Int. Cl.

| | |
|---|---|
| ***A45D 2/26*** | (2006.01) |
| ***A45D 2/14*** | (2006.01) |
| ***A45D 7/02*** | (2006.01) |
| ***A45D 2/12*** | (2006.01) |
| ***A45D 2/00*** | (2006.01) |
| ***A45D 2/08*** | (2006.01) |

(52) U.S. Cl.
USPC ..... 132/261; 132/248; 132/212; 132/226; 132/245; 132/250

(58) Field of Classification Search
USPC ..... 132/261, 203, 207, 210, 208, 212, 223, 132/224, 226, 228, 237, 243–246, 248–260, 132/264–267, 225, 138; 401/6, 10, 25–27
See application file for complete search history.

(56) References Cited

U.S. PATENT DOCUMENTS

| | | | | | |
|---|---|---|---|---|---|
| 23,842 | A | * | 5/1859 | Ivins | 132/251 |
| 1,360,643 | A | * | 11/1920 | Jacobs et al. | 132/131 |
| 1,439,271 | A | * | 12/1922 | Smidt | 132/261 |
| 1,471,881 | A | * | 10/1923 | Bove | 132/225 |
| 1,638,443 | A | * | 8/1927 | Kadane et al. | 132/226 |
| 1,724,249 | A | * | 8/1929 | Baldwin | 132/223 |
| 1,805,507 | A | * | 5/1931 | Adams | 132/261 |
| 1,974,924 | A | * | 9/1934 | MacDonald | 132/210 |
| 2,270,933 | A | * | 1/1942 | Davis | 132/244 |
| 2,276,196 | A | * | 3/1942 | Hommer | 132/249 |
| 2,599,505 | A | * | 6/1952 | Witmer | 132/131 |
| 2,660,182 | A | * | 11/1953 | Kaul | 132/109 |
| 2,695,620 | A | * | 11/1954 | Renstrom | 132/249 |
| 4,037,612 | A | | 7/1977 | Ferrier | |
| 4,151,850 | A | | 5/1979 | Nathe et al. | |
| 4,216,787 | A | * | 8/1980 | Moea | 132/250 |
| 4,243,061 | A | | 1/1981 | Buchanan | |
| 4,644,965 | A | * | 2/1987 | Alexander | 132/253 |
| 4,739,776 | A | * | 4/1988 | Prijic | 132/224 |
| 4,844,103 | A | * | 7/1989 | Vick et al. | 132/245 |
| 4,867,185 | A | * | 9/1989 | Clingen | 132/225 |
| 4,989,621 | A | * | 2/1991 | Keller | 132/245 |
| 5,025,850 | A | * | 6/1991 | Simpson | 132/225 |
| 5,119,846 | A | * | 6/1992 | Tadrous et al. | 132/225 |
| 5,285,800 | A | * | 2/1994 | Powers-McCarthy | 132/210 |
| 5,316,021 | A | * | 5/1994 | Giordano | 132/248 |
| 5,487,396 | A | * | 1/1996 | Wilson | 132/248 |
| 6,401,725 | B1 | * | 6/2002 | Beal | 132/248 |
| 6,453,910 | B1 | * | 9/2002 | Lloyd | 132/226 |
| 6,484,730 | B1 | | 11/2002 | Smith | |
| 2008/0251095 | A1 | * | 10/2008 | Pommer | 132/249 |

* cited by examiner

*Primary Examiner* — Vanitha Elgart

(57) ABSTRACT

A permanent hair wave device including a hollow first rod, having a length-adjustable arm disposed on a proximal end thereof, and a second rod parallel to the first rod, the second rod having an inner end attached to an internal wall of an internal wall of the arm proximal to an outside end thereof with an opening disposed between the rods. The rods can have a same or different diameter. An elastomeric band longitudinally engages each of the rods. Each band has an attachment end disposed on the arm and a cap end that sealingly engages a cavity within each rod. Hair strands are wrapped around the rods in a FIG. 8 configuration and the bands secure the hair strands against the rods during the application and processing of the permanent hair wave solution. Apertures and holes disposed in each of the respective rods and bands evenly distribute the solution.

16 Claims, 5 Drawing Sheets

PERMANENT HAIR WAVE DEVICE

CROSS-REFERENCE TO RELATED APPLICATIONS

U.S. Provisional Patent Application No. 61/489,036 filed May 23, 2011

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of hair styling devices are known in the prior art. However, what is needed is a permanent wave apparatus that has a pair of parallel rods of the same or different diameter attached to a length-adjustable arm, a band that stretches along each rod, a cap on the band which secures the band to a front end of the rod. The width-adjustable arm permits the adjustment of the distance between the rods.

FIELD OF THE INVENTION

The present invention relates to hair styling devices, and more particularly, to a permanent hair wave device.

SUMMARY OF THE INVENTION

The general purpose of the present permanent hair wave device, described subsequently in greater detail, is to provide a permanent hair wave device which has many novel features that result in a permanent hair wave device which is not anticipated, rendered obvious, suggested, or even implied by prior art, either alone or in combination thereof. The present permanent hair wave device is provided to permit the creation of a permanent soft wave hair style. To accomplish all of the foregoing, the present permanent hair wave device includes a hollow cylindrical permanent hair wave first rod, having a length-adjustable arm disposed on a proximal end thereof, and a second rod having an inner end attached to an internal wall of the arm internal wall proximal to an outside end thereof. The second rod is disposed in a position parallel to the first rod with an opening continuously disposed between the first rod and the second rod. The first and second rods can have a same diameter and alternately the diameter can be different sizes. The diameter is in a range of approximately one-eighth inch to approximately five inches.

An elastomeric band longitudinally engages each of the first rod and the second rod. Each band has an attachment end disposed on the arm and a cap end that sealingly engages a cavity within each rod. The first rod and the second rod are configured to removably receive a plurality of hair strands of a section of hair therearound in a FIG. 8 configuration and the bands are configured to secure the hair strands against the first and second rods during the application and processing of the permanent hair wave solution.

A plurality of apertures longitudinally disposed in each of the first rod and the second rod and a plurality of holes longitudinally disposed in each of the band are configured to permit the passage of a permanent hair wave solution therethrough to obtain even distribution onto each hair strand. The device is formed of materials that can endure exposure to permanent hair wave solution and that can be easily cleaned and maintained, such as plastic and hard rubber. The device has a total length in a range of approximately 1½% inches to approximately 6 inches. The structure and arrangement of the first and second rods permits a user to create a soft permanent hair wave style similar to a finger wave hairstyle popular in the 1920s and 1930s, which is easy to wear and requires little day-to-day maintenance Thus has been broadly outlined the more important features of the present permanent hair wave device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
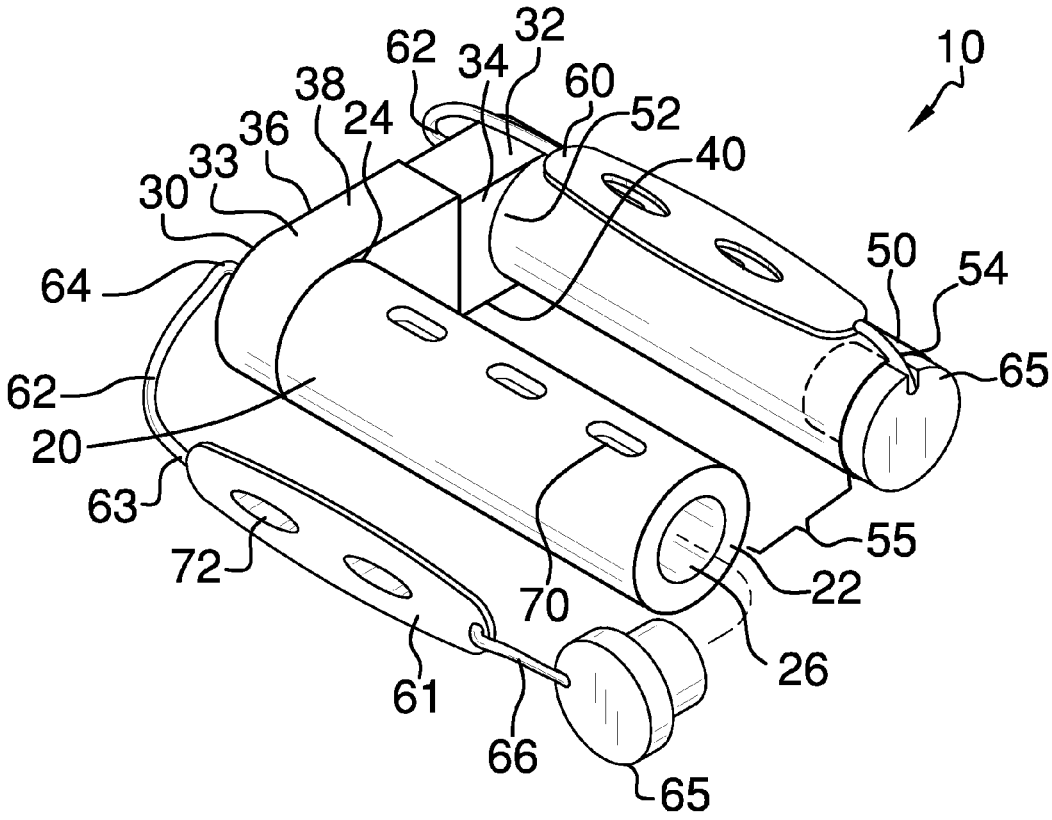
FIG. 1 is an isometric view.
Figure 2:
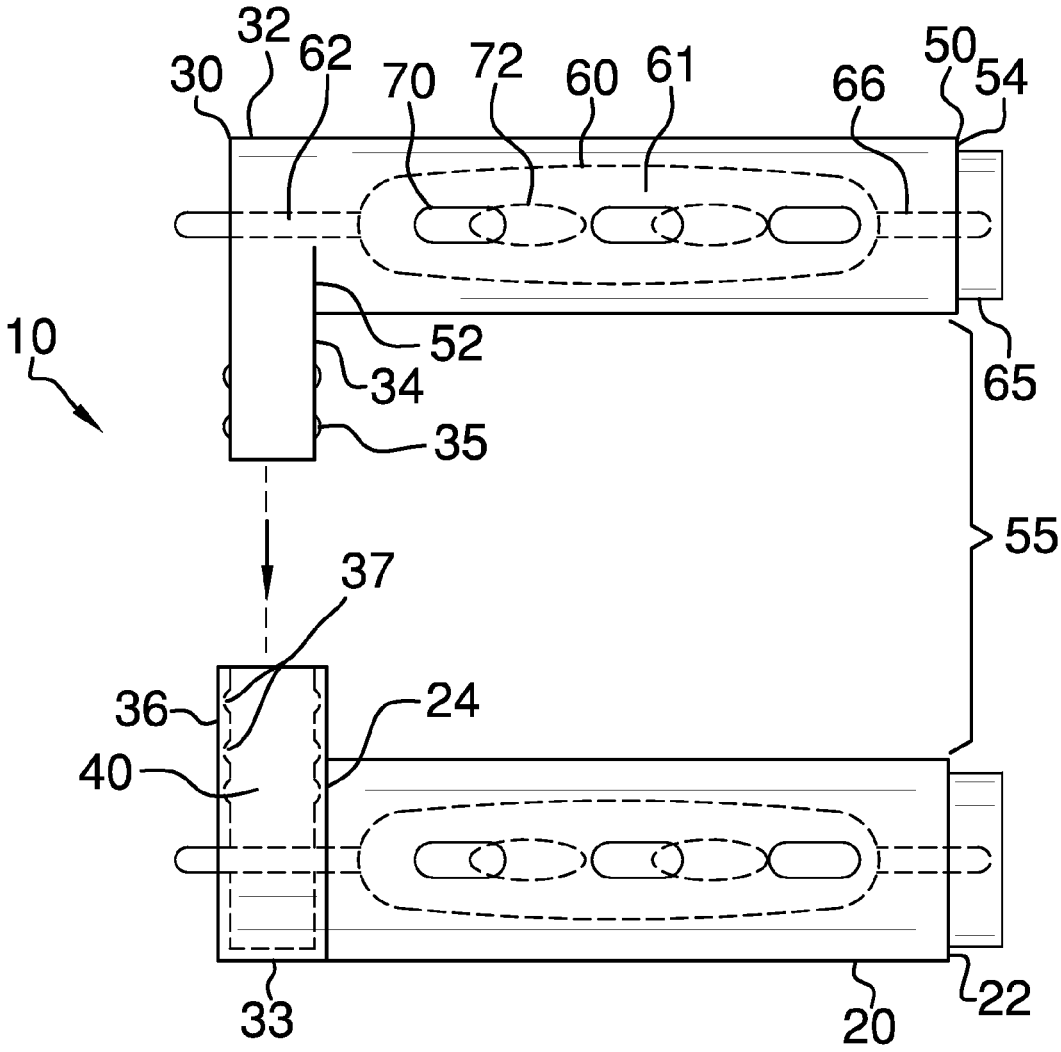
FIG. 2 is a bottom plan view.
Figure 3:
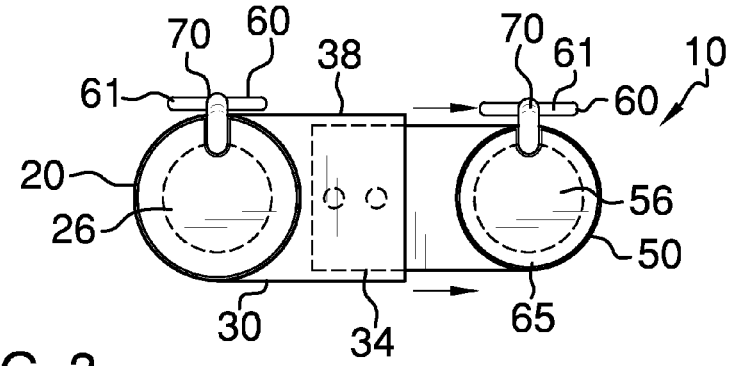
FIG. 3 is a front elevation view.
Figure 4:
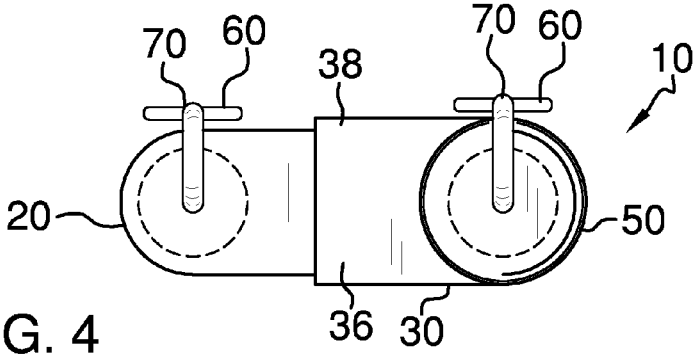
FIG. 4 is a rear elevation view.
Figure 5:
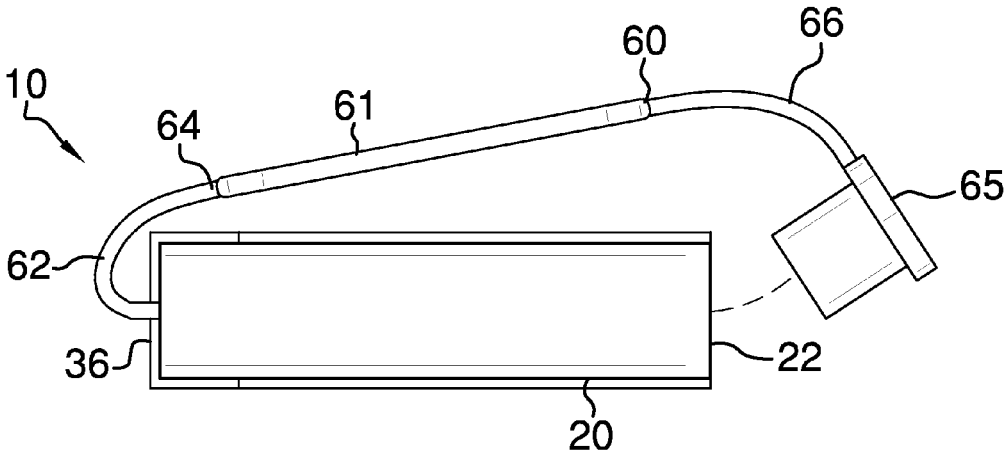
FIG. 5 is a side elevation view.
Figure 6:
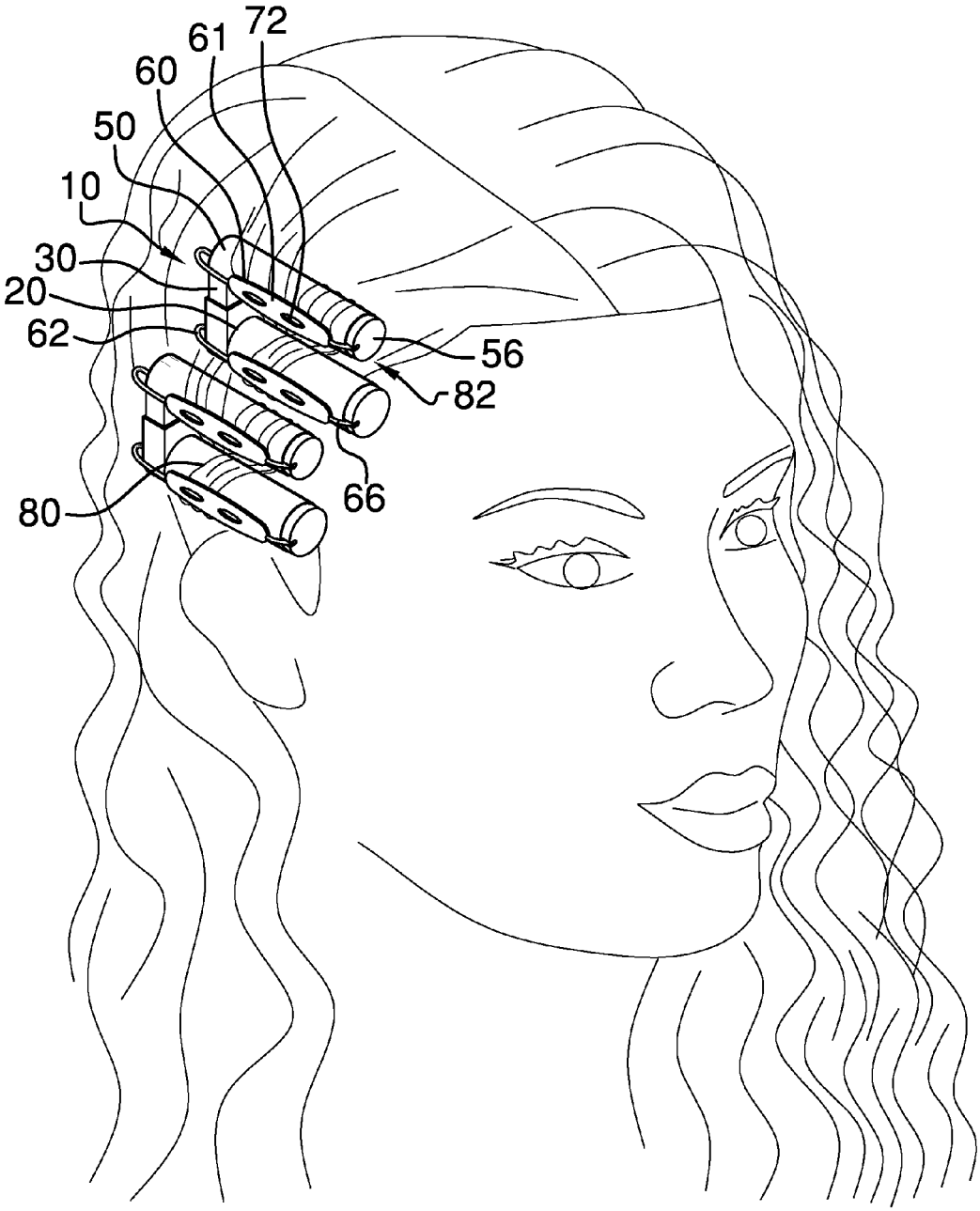
FIG. 6 is an in-use isometric view.

With reference now to the drawings, and in particular FIGS. 1 through 7B hereof, example of the instant permanent hair wave device employing the principles and concepts of the present permanent hair wave device and generally designated by the reference number 10 will be described.

Referring to FIGS. 1 through 7B a preferred embodiment of the present permanent hair wave device 10 is illustrated. The permanent hair wave device 10 includes a hollow cylindrical permanent hair wave first rod 20. The first rod 20 has a distal end 22, a proximal end 24, and a longitudinally disposed first cavity 26. A length-adjustable arm 30 is disposed on the proximal end 24 of the first rod 20. The arm 30 has an outside end 32, an inside end 33 that slidably securingly engages the outside end 32, an internal wall 34, an external wall 36, a top wall 38, and a bottom wall 40. The instant device 10 also includes a hollow cylindrical permanent hair wave second rod 50. The second rod 50 has an inner end 52, an outer end 54, and a longitudinally disposed second cavity 56. Both the first rod 20 and the second rod 50 can be molded onto the arm 30 as a single unitary body or attached to the arm 30 as separate components.

The second rod 50 is disposed in a position parallel to the first rod 20. An elongated opening 55 is continuously disposed between the first rod 20 and the second rod 50. The inner end 52 of the second rod 50 is attached to the arm 30 internal wall 34 proximal to the outside end 32 of the arm 30. The slidable engagement of the outside end 32 and the inside end 33 of the arm permits adjustment of the size of the opening or, in other words, the distance between the first and second rods 20, 50 to be adjusted and secured into place during use. A plurality of protrusions 35 disposed on the outside end 32 adjustably lockingly engage a plurality of internal recesses 37 disposed within the inside end 33 to adjust the arm 30 length thereby adjusting the distance between the first and second rods 20, 50.

Figure 7A:
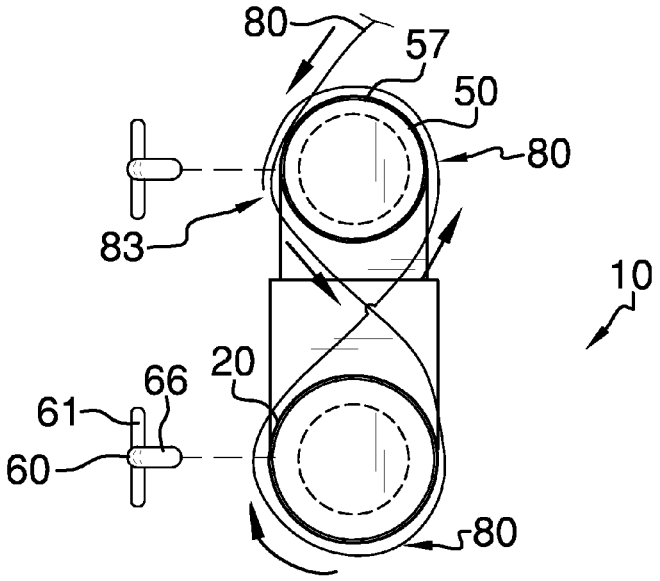
FIG. 7A is an in-use side elevation view illustrating the winding of hair around a pair of rods.
Figure 7B:
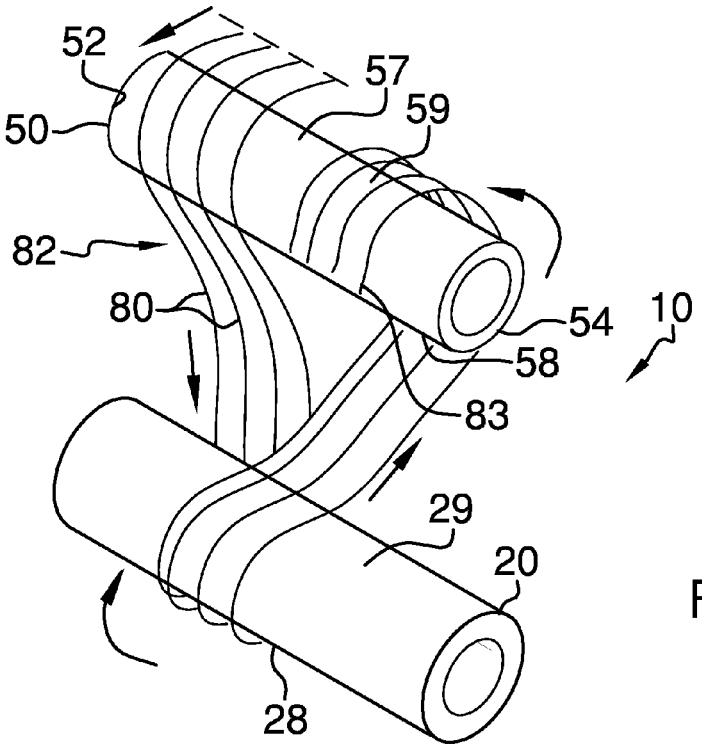
FIG. 7B is an enlarged in-use isometric view showing the winding of hair around the rods.

An elastomeric band 60 longitudinally engages each of the first rod 20 and the second rod 50. Each band 60 has a body 61, an elastic attachment end 62 having a first end 63 attached to the body 61 and a second end 64 disposed on the arm 30 and a cap end 65. An elastic securement member 66 is disposed between the body 61 and the cap end 65. Each cap end 65 sealingly engages one of the first cavity 26 at the distal end 22 of the first rod 20 and the second cavity 56 at the outer end 54 of the second rod 50. The first rod 20 and the second rod 50 are configured to removably receive a plurality of hair strands 80 of a section of hair 82 therearound in a FIG. 8 configuration as shown in FIGS. 7A and 7B and the bands 60 are configured to secure the hair strands 80 against the first and second rods 20, 50 during the application and processing of the permanent hair wave solution when each cap 65 is pushed into the respective cavities 26, 56. The body 61 of each band 60 is wider than the attachment end 62 and the securement member 66 in order to cover more of the respective first rod 20 and second rod 50 thereby securing the hair strands against the respective first and second rod 20, 50 regardless of the position of the ends 83 of the hair strands 80.

A plurality of apertures 70 is longitudinally disposed in each of the first rod 20 and the second rod 50. A plurality of holes 72 is longitudinally disposed in each of the bands 60. Each of the apertures 70 and the holes 72 is configured to permit the passage of a permanent hair wave solution therethrough to obtain even distribution onto each hair strand. The holes 72 adjustably overlap the apertures 70.

Each of the first rod 20 and the second rod 50 has a diameter. The diameter of each of the first rod 20 and the second rod 50 can be the same and can alternately be different sizes. The diameter of each of the first and second rod 20, 50 is in a range of approximately one-eighth inch to approximately five inches.

The FIG. 8 configuration, by which the hair strands 80 are wrapped around the first and second rods 20, 50, begins on an upper side 57 of the second rod 50 that removably receives the hair strands 80 of the section of hair 82 thereover proximal to the inner end 52, continues to an underside 28 of the first rod 20 that removably receives the hair strands 80 thereunder proximal to a center portion 29 of the first rod 20, further continues to a lower side 58 of the second rod 50 that removably receives the hair strands 80 thereunder proximal to the outer end 54, and ends proximal to the upper side 57 of the second rod 50 that removably receives the hair strands 80 thereover proximal to a central portion 59 of the second rod 50.

The device 10 is formed of materials that can endure exposure to permanent hair wave solution and that can be easily cleaned and maintained, such as plastic and hard rubber. The device 10 has a total length in a range of approximately 1% inches to approximately 6 inches. The slidable engagement of the outside end 32 and the inside end 33 of the arm 30 permits the adjustment of the arm 30 to permit the opening 55 between the first and second rods 20, 50 to have a width of approximately one-half inch to 3 inches.

The structure and arrangement of the first and second rods 20, 50 permits a user to create a soft permanent hair wave style similar to a finger wave hairstyle popular in the 1920s and 1930s.

What is claimed is:

1. A permanent hair wave device comprising:

a hollow cylindrical permanent hair wave first rod having a distal end, a proximal end, and a longitudinally disposed first cavity;

a length-adjustable arm disposed on the proximal end, the arm having an outside end, an inside end slidably securingly engaging the outside end, an internal wall, an external wall, a top wall, and a bottom wall;

a hollow cylindrical permanent hair wave second rod having an inner end, an outer end, and a longitudinally disposed second cavity;

wherein the second rod is disposed in a position parallel to the first rod;

an elongated opening continuously disposed between the first rod and the second rod;

wherein the inner end is attached to the arm internal wall proximal to the outside end of the arm;

an elastomeric band longitudinally engaging each of the first rod and the second rod;

wherein each band has an attachment end attached to the arm and a cap end opposite the attachment end; and wherein each cap end sealingly engages one of the first cavity at the distal end of the first rod and the second cavity at the outer end of the second rod;

a plurality of apertures longitudinally disposed in each of the first rod and the second rod;

a plurality of holes longitudinally disposed in each of the bands;

wherein each of the apertures and the holes is configured to permit the passage of permanent hair wave solution therethrough.

2. The permanent hair wave device of claim 1 wherein each of the first rod and the second rod has a diameter;

wherein the diameter of each of the first rod and the second rod is the same.

3. The permanent hair wave device of claim 1 wherein each of the first rod and the second rod has a diameter;

wherein the diameter of the first rod has a different size than the diameter of the second rod.

4. The permanent hair wave device of claim 2 wherein the diameter is in a range of approximately one-eighth inch to five inches.

5. The permanent hair wave device of claim 3 wherein the diameter of each of the first rod and the second rod is in a range of approximately one-eighth inch to five inches.

6. A permanent hair wave device comprising:

a hollow cylindrical permanent hair wave first rod having a distal end, a proximal end, and a longitudinally disposed first cavity;

a length-adjustable arm disposed on the proximal end, the arm having an outside end, an inside end slidably securingly engaging the outside end, an internal wall, an external wall, a top wall, and a bottom wall;

a hollow cylindrical permanent hair wave second rod having an inner end, an outer end, and a longitudinally disposed second cavity;

wherein the second rod is disposed in a position parallel to the first rod;

an elongated opening continuously disposed between the first rod and the second rod;

wherein the inner end is attached to the arm internal wall proximal to the outside end of the arm;

an elastomeric band longitudinally engaging each of the first rod and the second rod;

wherein each band has a body, an attachment end having a first end attached to the body and a second end disposed on the arm, a cap end opposite the attachment end, and an elastic securement member disposed between the body and the cap end;

wherein each cap end sealingly engages one of the first cavity at the distal end of the first rod and the second cavity at the outer end of the second rod; and wherein the first rod and the second rod are configured to removably receive a plurality of hair strands of a section of hair therearound in a FIG. 8 configuration.

7. The permanent hair wave device of claim 6 further comprising a plurality of protrusions disposed on the outside end adjustably lockingly engaging a plurality of internal recesses disposed within the inside end, wherein the adjustable locking engagement of the protrusions and the recesses adjust the arm length whereby the distance between the first rod and the second rods is adjusted.

8. The permanent hair wave device of claim 7 further comprising:

a plurality of apertures longitudinally disposed in each of the first rod and the second rod.

9. The permanent hair wave device of claim 8 further comprising:

a plurality of holes longitudinally disposed in each of the bands; and wherein each of the apertures and the holes is configured to permit the passage of permanent hair wave solution therethrough.

10. The permanent hair wave device of claim 9 wherein the body is wider than each of the attachment end and the securement member.

11. The permanent hair wave device of claim 10 wherein each of the first rod and the second rod has a diameter;

wherein the diameter of each of the first rod and the second rod is the same.

12. The permanent hair wave device of claim 10 wherein each of the first rod and the second rod has a diameter;

wherein the diameter of the first rod has a different size than the diameter of the second rod.

13. The permanent hair wave device of claim 11 wherein the diameter is in a range of approximately one-eighth inch to five inches.

14. The permanent hair wave device of claim 12 wherein the diameter of each of the first rod and the second rod is in a range of approximately one-eighth inch to five inches.

15. A permanent hair wave device comprising:

a hollow cylindrical permanent hair wave first rod having a distal end, a proximal end, and a longitudinally disposed first cavity;

a length-adjustable arm disposed on the proximal end, the arm having an outside end, an inside end slidably securingly engaging the outside end, an internal wall, an external wall, a top wall, and a bottom wall;

a hollow cylindrical permanent hair wave second rod having an inner end, an outer end, and a longitudinally disposed second cavity;

wherein the second rod is disposed in a position parallel to the first rod;

an elongated opening continuously disposed between the first rod and the second rod;

wherein the inner end is attached to the arm internal wall proximal to the outside end of the arm;

a plurality of protrusions disposed on the outside end adjustably lockingly engaging a plurality of internal recesses disposed within the inside end, wherein the adjustable locking engagement of the protrusions and the recesses adjust the arm length whereby the distance between the first rod and the second rods is adjusted;

an elastomeric band longitudinally engaging each of the first rod and the second rod;

wherein each band has a body, an attachment end having a first end attached to the body and a second end disposed on the arm, a cap end opposite the attachment end, and an elastic securement member disposed between the body and the cap end;

wherein the body is wider than each of the attachment end and the securement member;

wherein each cap end sealingly engages one of the first cavity at the distal end of the first rod and the second cavity at the outer end of the second rod;

a plurality of apertures longitudinally disposed in each of the first rod and the second rod;

a plurality of holes longitudinally disposed in each of the bands;

wherein each of the apertures and the holes is configured to permit the passage of permanent hair wave solution therethrough;

wherein each of the first rod and the second rod has a diameter;

wherein the diameter is in a range of approximately one-eighth inch to five inches;

wherein the first rod and the second rod are configured to removably receive a plurality of hair strands of a section of hair therearound in a FIG. 8 configuration; and wherein the FIG. 8 configuration begins on an upper side of the second rod that removably receives a plurality of hair strands of a section of hair thereover proximal to the inner end, continues to an underside of the first rod that removably receives the hair strands thereunder proximal to a center portion of the first rod, further continues to a lower side of the second rod that removably receives the hair strands thereunder proximal to the outer end, and ends on the upper side of the second rod that removably receives the hair strands thereover proximal to a central portion of the second rod.

16. The permanent hair wave device of claim 15 wherein the holes adjustably overlap the apertures.

* * * * *